US007780160B2

(12) United States Patent
Sato

(10) Patent No.: US 7,780,160 B2
(45) Date of Patent: Aug. 24, 2010

(54) POST-PROCESSING APPARATUS BOOKBINDING APPARATUS AND IMAGE FORMING SYSTEM

(75) Inventor: Hiroyasu Sato, Machida (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 171 days.

(21) Appl. No.: 11/730,626

(22) Filed: Apr. 3, 2007

(65) Prior Publication Data

US 2008/0056792 A1 Mar. 6, 2008

(30) Foreign Application Priority Data

Aug. 30, 2006 (JP) ..... 2006-233327

(51) Int. Cl.

| | |
|---|---|
| ***B41L 43/00*** | (2006.01) |
| ***B41L 43/12*** | (2006.01) |
| ***B65H 33/04*** | (2006.01) |
| ***B65H 39/00*** | (2006.01) |

(52) U.S. Cl. ..... 270/58.12; 270/32; 270/37; 270/58.07; 270/58.08; 270/58.13; 270/58.28; 412/1; 271/220

(58) Field of Classification Search ..... 270/32, 270/37, 58.07, 58.08, 58.12, 58.13, 58.28
See application file for complete search history.

(56) References Cited

U.S. PATENT DOCUMENTS

| | | | | |
|---|---|---|---|---|
| 5,735,659 | A | 4/1998 | Kosasa et al. | |
| 6,726,423 | B2 * | 4/2004 | Hocking | 412/1 |
| 2004/0141830 | A1 * | 7/2004 | Yoshie et al. | 412/1 |
| 2004/0183249 | A1 * | 9/2004 | Sato | 271/220 |
| 2007/0045928 | A1 * | 3/2007 | Yoshie et al. | 270/58.08 |

FOREIGN PATENT DOCUMENTS

| | | | |
|---|---|---|---|
| EP | 1 219 552 | A1 | 7/2002 |
| EP | 1 486 831 | A1 | 12/2004 |
| GB | 2 072 630 | A | 10/1981 |
| JP | 2004-209870 | | 7/2004 |
| JP | 2004-209870 | A * | 7/2004 |

OTHER PUBLICATIONS

Japanese Office Action mailed Sep. 30, 2008.
European Search Report dated Feb. 12, 2008.

* cited by examiner

*Primary Examiner*—Gene Crawford
*Assistant Examiner*—Yolanda Cumbess
(74) *Attorney, Agent, or Firm*—Finnegan, Henderson, Farabow, Garrett & Dunner, LLP

(57) ABSTRACT

A post-processing apparatus having a conveyance device to convey a sheet, a sheet bundle storing device to load and store the sheets conveyed by the conveyance device as a sheet bundle, a moving device to enable the sheet bundle storing device to be movable, a post-processing device to carry out post-process for the sheet bundle accumulated in the sheet bundle storing device, wherein the sheet bundle storing device can be withdrawn to outside the post-processing apparatus main body through the moving device so as to be capable of storing the sheet bundle from outside.

9 Claims, 11 Drawing Sheets

POST-PROCESSING APPARATUS BOOKBINDING APPARATUS AND IMAGE FORMING SYSTEM

This application is based on Japanese Patent Application No. 2006-233327 filed on Aug. 30, 2006, in Japanese Patent Office, the entire content of which is hereby incorporated by reference.

BACKGROUND OF THE INVENTION

The present invention relates to a post-processing apparatus and a bookbinding apparatus having a sheet bundle storing device to accumulate sheets and to store sheet bundles, and related to an image forming system having the aforesaid post-processing apparatus and the bookbinding apparatus.

For example, in an electrophotographic method image forming apparatus has a high-speed performance, a multi-function and a network function, and its application as a printing apparatus is being expanding by connecting with a large capacity sheet feeding apparatus and a large capacity stacker.

In case the image forming apparatus is used as a printing apparatus, one system can perform a job from printing to bookbinding in a single successive workflow by connecting the bookbinding apparatus to bind printed matters.

In a bookbinding apparatus of Patent document 1, sheets on which images are formed in an image forming apparatus are accumulated in a sheet accumulating apparatus having an oblique sheet accumulating surface and forms a sheet bundle which composes a book, and the sheet bundle is transferred to jointing process section, and thereafter the sheet bundle is turned to a vertical condition, then glue is applied and a front cover is jointed onto the sheet bundle in the vertical condition, so as to make a book.

Also, a bookbinding process wherein one sheet bundle accumulating printed sheets is covered by a front cover sheet (coversheet) in U-shape is known as a bookbinding process.

In Patent document 1, a compact size bookbinding apparatus is proposed to enable coupling up of the image forming apparatus and the printing apparatus.

Patent Document 1: Unexamined Japanese Patent Application Publication No. 2004-209869

In the bookbinding apparatus disclosed by Patent document 1, when bookbinding is manually executed by changing into offline system, the sheet bundle is loaded on a coversheet supplying device. The sheet loaded is fed to a sheet bundle storing device one by one and a sheet bundle is formed by a sheet bundle conveyance device, and then bookbinding process is carried out in a bookbinding processing section having a glue applying device, a coversheet adhesion device and coversheet folding device.

However, in case of cast work, for example, up to a maximum of 300 pieces of the sheets are bound. Thus it takes an enormous time, if the sheets are fed one by one.

SUMMARY OF THE INVENTION

An aspect of the present invention is as follows.

1) A-post-processing apparatus configured to change between an online system to conduct post-processing wherein a plurality of sheets from an image forming apparatus are received and an offline system wherein the post-processing is conducted alone, comprising:

a sheet conveyance device to convey the sheets;

a post-processing device to conduct the post-processing; and a sheet bundle storing device, having a supporting member to accumulate the sheets thereon, a receiving plate disposed at a position of a front edge of a sheet bundle on the supporting member in a forwarding direction, a lateral aligning member to conduct lateral aligning of the sheet bundle accumulated on the supporting member in a width direction, a pressure member to press the sheet bundle onto the supporting member, a grasping device to grasp the sheet bundle by pressing the sheet bundle between the supporting member and pressure member, and position the sheet bundle at a post-processing position in a state of grasping by pressure, and a moving device to move the sheet bundle storing device to outside the post-processing apparatus;

wherein when the online system is selected, the sheets sent from the image forming apparatus are consecutively accumulated on the supporting member by the sheet conveyance device, lateral aligning is conducted by operating the lateral aligning member, the supporting member and the pressure member in the state where the sheet bundle is grasped by pressure by operating the grasping device are positioned at the post-processing position after completion of accumulation and aligning, and the post-processing is conducted by the post-processing device, and when the offline system is selected, the sheet bundle is placed on the supporting member of the sheet bundle storing device having been moved outside the post-processing apparatus through the moving device, lateral aligning is conducted manually though the lateral aligning member having been released from driving, and after the sheet bundle storing device is returned to an initial position, the post-processing is conducted by operating the grasping device and the post-processing device.

2) A book binding apparatus configured to change between an online system to conduct book binding processing wherein a plurality of sheets from an image forming apparatus are received and an offline system wherein the book binding is conducted alone, comprising:

a sheet conveyance device to convey the sheets;

a book binding device to conduct book binding; and a sheet bundle storing device, having a supporting member to accumulate the sheets thereon, a receiving plate disposed at a front edge of a sheet bundle on the supporting member in a forwarding direction, a lateral aligning member to conduct lateral aligning of the sheet bundle accumulated on the supporting member in a width direction, a pressure member to press the sheet bundle on the supporting member, a grasping device to grasp the sheet bundle by pressing the sheet bundle between the supporting member and pressure member, and position the sheet bundle at a bookbinding position in a state of grasping by pressure, and a moving device to move the sheet bundle storing device to outside the book binding apparatus;

an adhesive applying device to apply an adhesive on the edge surface of the sheet bundle positioned at the book binding position;

a cover sheet supplying device to supply a coversheet to the edge surface of the sheet bundle to which the adhesive has been applied; and a square spine forming device to form a square spine by contacting the coversheet supplied to the edge surface of the sheet bundle with pressure and folding the coversheet, wherein when the online system is selected, the sheets sent from the image forming apparatus are consecutively accumulated on the supporting member by the sheet conveyance device, lateral aligning is conducted by operating the lateral aligning member, the supporting member and the pressure member in the state where the sheet bundle is grasped by pressure by operating the grasping device are positioned at the book-binding position after completion of accumulation and aligning, and the book binding is conducted by the book binding device, and when the offline system is selected, the sheet bundle is placed on the supporting member of the sheet bundle storing device having been moved outside the book binding apparatus through the moving device, lateral aligning is conducted manually though the lateral aligning member having been released from driving, and after the sheet bundle storing device is returned to an initial position, the book binding is conducted by operating the grasping device and the book binding device.

3) An image forming system, comprising:

an image forming apparatus main body to form an image on a recording sheet based on document data; and a post-processing apparatus of (1).

4) An image forming system, comprising:

an image forming apparatus main body to form an image on a recording sheet based on document data; and a book binding apparatus of (2).

DETAILED DESCRIPTION OF THE PREFERRED EMBODIMENT

Figure 1:
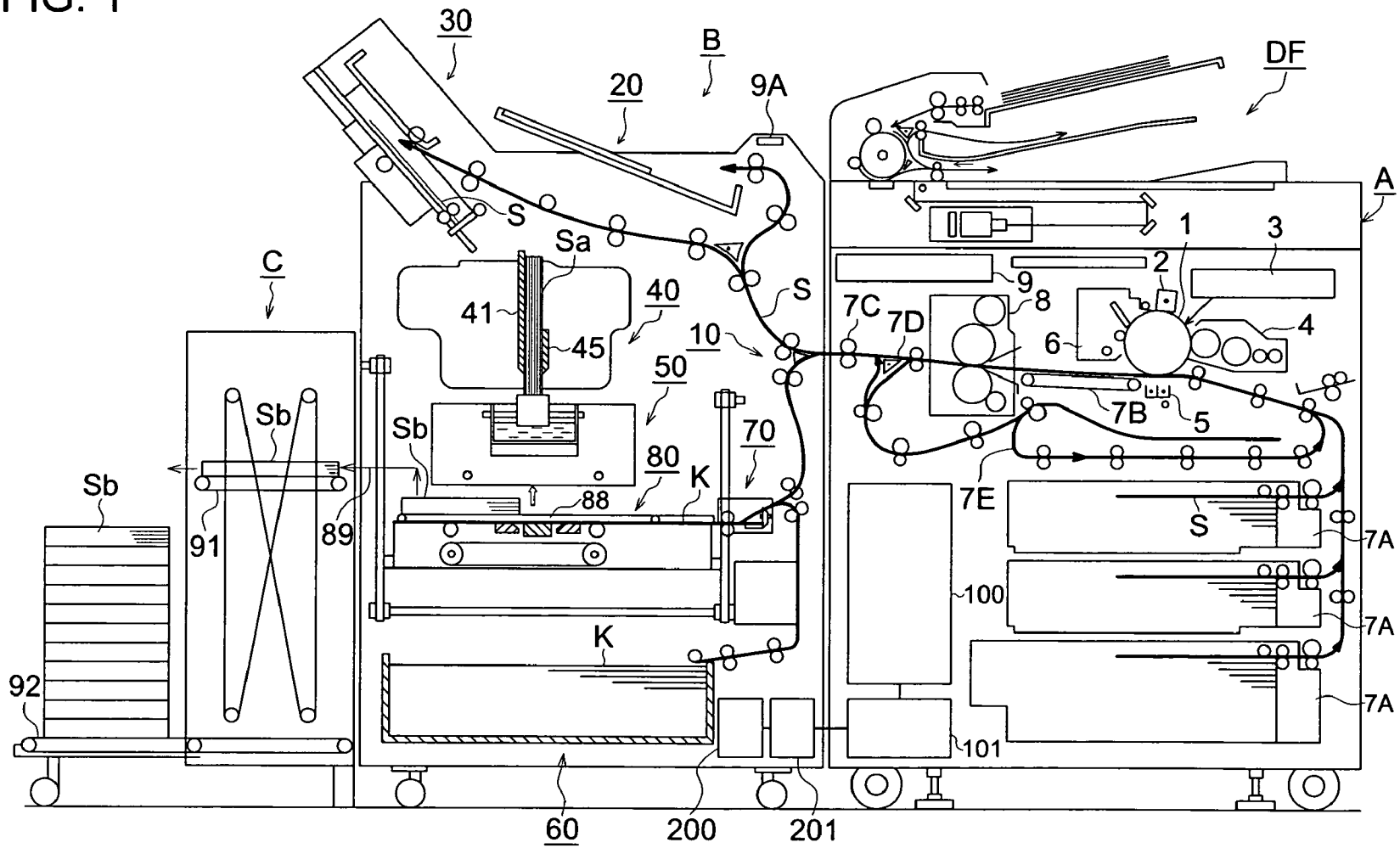
FIG. 1 is a total structural view of an image forming system having an image forming apparatus main body, a bookbinding apparatus and a booklet storing apparatus.

The bookbinding apparatus and image forming system having the bookbinding apparatus of the present invention are explained with reference to the drawings without the present invention being restricted thereto. FIG. 1 is a total configuration view of an image forming system having image forming apparatus main body A, bookbinding apparatus (post-processing apparatus) B, booklet storing apparatus C and automatic document feeding apparatus DF.

<Image Forming Apparatus Main Body A>

Image forming apparatus main body A is provided with an image forming device where charging device 2, image exposing device 3, developing device 4, transfer neutralization device 5 and cleaning device 6 are disposed in a peripheral of image carrier 1 which can rotate.

After charging device 2 carries out uniform charging on a surface of image carrier 1, the image forming device forms a latent image through exposure scanning based on image data read from a document through a laser beam of image exposing device 3, and developing device 4 develops the latent image through reversal development so as to form a toner image on a surface of image carrier 1.

A recording sheet S (hereinafter call sheet) fed from sheet storing device 7A, is sent to a transfer position. After the toner image is transferred onto sheet S through transfer neutralization device 5 in the transfer position, charge of sheet S is erased and sheet S is separated from image carrier 1. Then sheet S is conveyed through conveyance device 7B and successively fixed by heat through fixing device 8 and then ejected from sheet ejecting roller 7C.

In case the image is formed on both sides of sheet S, sheet S fixed by heat through fixing device 8 is branched from a normal sheet ejection pass by conveyance pass switching device 7D and is reversed upside down through switching back in reversal conveyance device 7E. After that, sheet S goes through image forming section again to form an image on a reverse side of sheet S, then through fixing device 8, sheets S is ejected by sheet ejecting roller 7C to outside the apparatus. Sheet S ejected from sheet ejection roller 7C is fed into bookbinding apparatus B.

The surface of image carrier 1 after image processing is cleaned by cleaning device 6 to remove remaining developer on the surface, thereby being ready for next image forming.

On an upper section of image forming apparatus main body A, operation device 9 provided with an input device and a display device is disposed.

<Bookbinding Apparatus B>

As FIG. 1 shows, bookbinding apparatus B related to the present invention is a case work bookbinding apparatus having sheet conveyance device 10, sheet ejection device 20, sheet reversal device 30, sheet bundle storing device 40, bonding adhesive applying device 50, coversheet supplying device 60, coversheet cutting device 70 and square spine forming device 80. Each of the devices is disposed serially in a substantially vertical direction inside bookbinding apparatus B.

Meanwhile, the post-processing apparatus of the present invention is applicable to a side stitching device, a saddle folding and stitching device and a cast sealing device, besides the case work bookbinding device.

Main control device 100 of image forming apparatus main body A and post-processing control device 200 of bookbinding device B are connected through serial communication devices 101 and 102.

Figure 2:
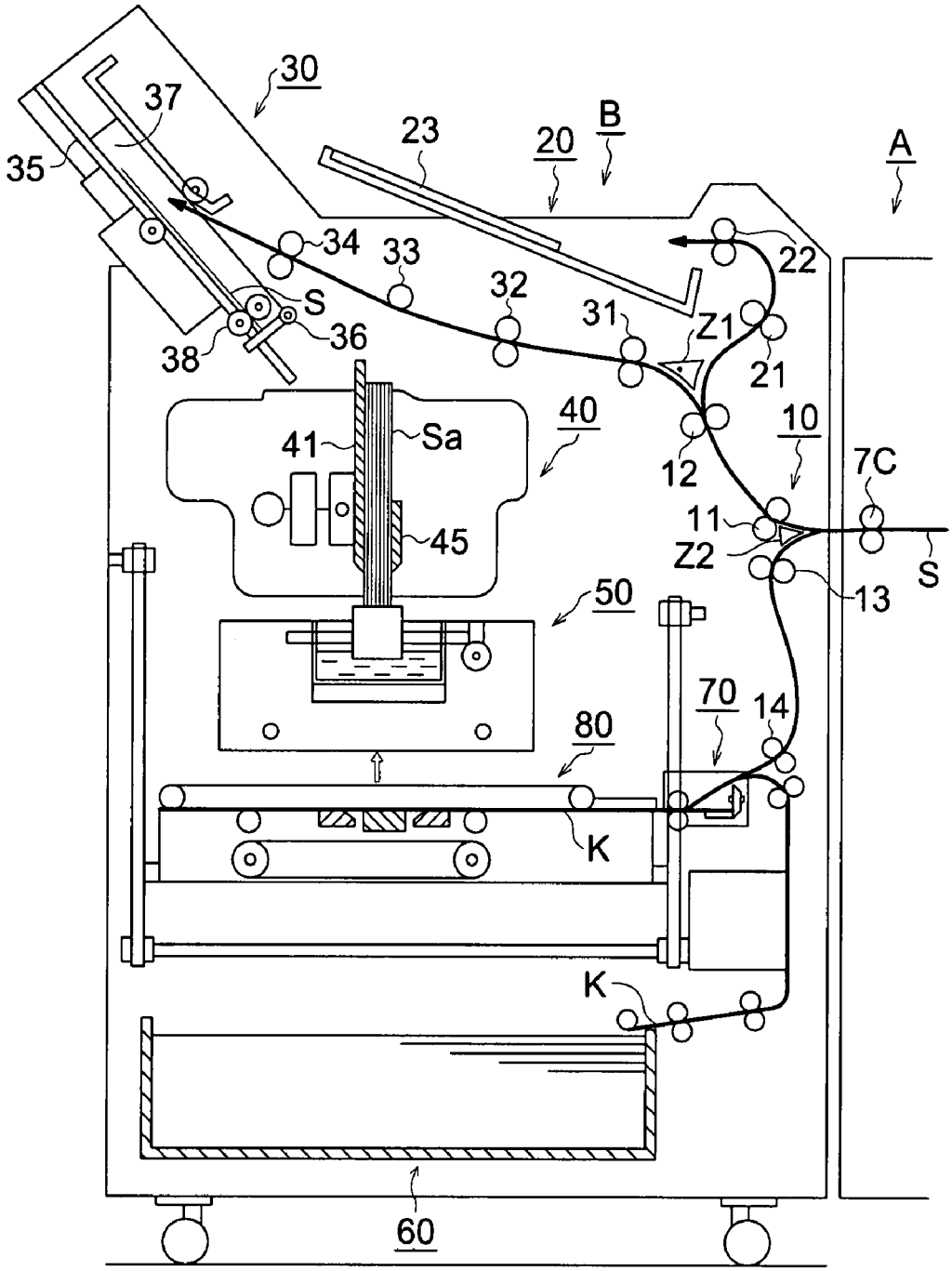
FIG. 2 is a cross-sectional view of the bookbinding apparatus related to the present invention.

FIG. 2 is a cross-sectional view of bookbinding device B related to the present invention.

<Sheet Conveyance Device 10>

Sheet S introduced into sheet conveyance device 10 is grasped by conveyance rollers 11 and 12 to be conveyed and then branched either to sheet ejection device 20 or to sheet reversal device 30 through conveyance pass switching device Z1.

Conveyance pass switching device Z2 disposed at an upstream side of conveyance roller 11 in a sheet conveyance direction sends sheet S ejected from image forming apparatus main body A either to a conveyance pass of conveyance roller 11 or to a conveyance pass of conveyance roller 13. Sheet S conveyed to the conveyance pass of conveyance roller 13 is grasped by conveyance roller 14 to be conveyed to square spine forming device 80.

<Sheet Ejection Device 20>

If this conveyance pass to sheet ejection device 20 is selected, conveyance pass switching device Z1 shuts off a conveyance pass to sheet bundle storing device 40 and opens a conveyance pass to sheet ejection device 20.

Sheet S passing through the conveyance pass of sheet ejection device 20 is grasped by conveyance roller 21 to be conveyed upward, then sheet S is ejected by sheet ejection roller 22 and stored on fixed sheet ejection tray 23 on a top of the apparatus through ejection roller 22. Fixed sheet ejection tray 23 is able to directly receive sheet S ejected from image forming apparatus main body A and load approximately 200 pieces of sheets S on it.

<Sheet Reversal Device 30>

Sheet S divaricated by conveyance pass switching device Z1 leftward in the figure in a downstream side of a sheet conveyance direction is grasped by conveyance rollers 31, 32, 33 and 34 to be stored in a prescribed position in sheet reversal device 30. Sheet reversal device 30 has obliquely disposed sheet loading table 35, sheet end positioning member 36, which can swing, sheet width aligning member 37, conveyance roller 38 and rear end aligning member 39.

<Sheet Bundle Storing Device 40>

Figure 3:
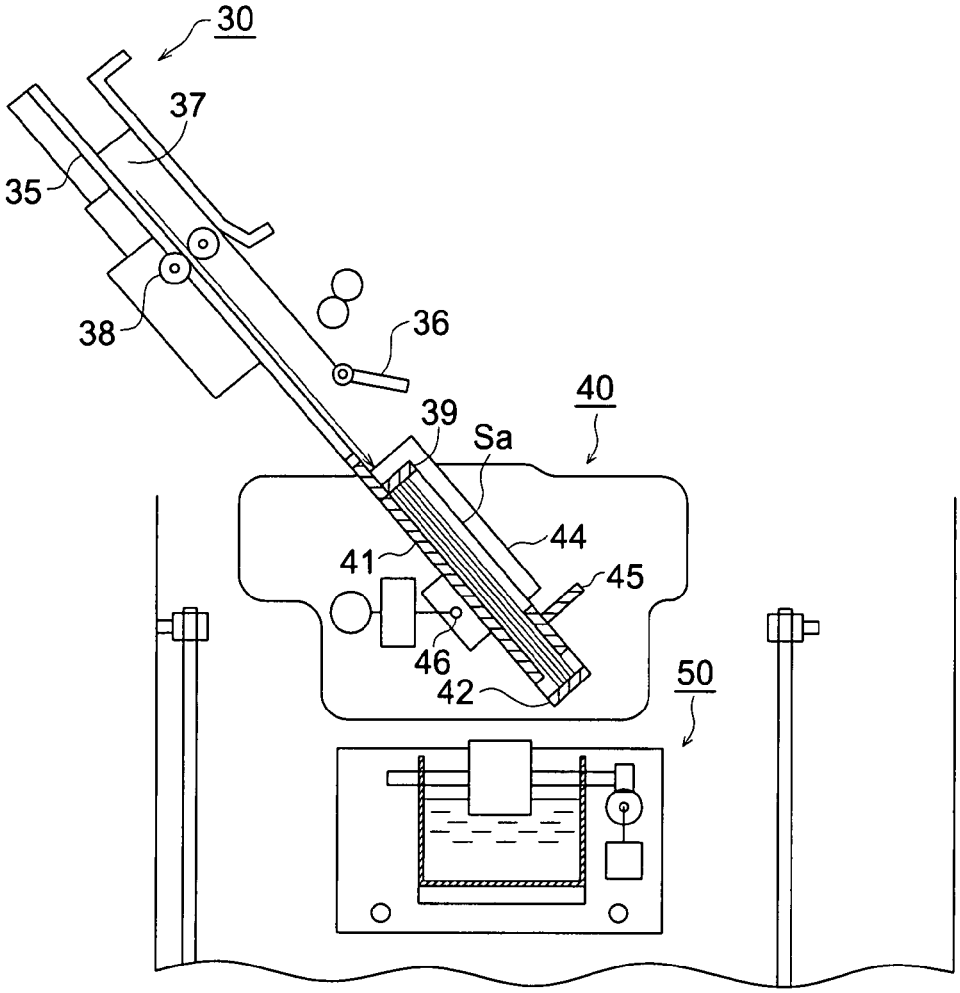
FIG. 3 is a cross-sectional view of a status where a sheet accumulating device of a sheet bundle storing device is obliquely disposed.

FIG. 3 is a cross-sectional view showing a status where the sheet accumulation device of sheet bundle storing device 40 is disposed obliquely.

The sheet accumulation device has supporting member 41, receiving plate 42, lateral aligning member 44 and imposing member 45.

Sheets S placed on sheet set on table 35 of sheet reversal device 30 is grasped by roller 38 and ejected from an opening opened by swing of sheet rear end positioning member 36 to be conveyed downward on an angle. Sheets S are stored and accumulated successively in sheet bundle storing device 40.

Sheet bundle storing device 40 has supporting member 41 having an oblique accumulation surface and receiving plate 42 which can swing. Sheet S which comes down from sheet reversal device 30 slips on the accumulating surface and falls down until a front edge section of sheet S comes in contact with receiving plate 42 and stops, thereby being supported in an oblique status.

Rear end aligning member 39, pushes the rear end section of sheet S so that the front end section of sheet S comes in contact with receiving plate 42 for aligning the front end section (longitudinal aligning) in accordance with the size of sheet S placed on the accumulation surface.

Sheets S successively ejected from image forming apparatus main body A are conveyed by switching back in sheet reversal device 30 and accumulated in sheet bundle storing device 40. Then longitudinal aligning and lateral aligning to be described are conducted to form sheet bundle Sa configured with a plurality of sheets S.

A size of sheet S and number of the sheets configuring sheet bundle Sa, are set through operation device 9 of image forming apparatus main body A shown in FIG. 1. Or they are set on an external devices such as personal computers connected with image forming apparatus main body A.

Lateral aligning member 44, pushes a side edge of sheet S conveyed from sheet reversal device 30 and stored in sheet bundle storing device 40 so as to align sheet s in a width direction (lateral alignment) while an online system in which a process from image forming to bookbinding is carried out automatically is in operation.

While an offline system in which bookbinding is conducted alone, a power supply to lateral aligning member 44 is stopped, and the width direction of the sheet bundle conveyed from outside to sheet bundle storing device 40 is aligned by operating lateral aligning member 44 manually.

Pressure member 45 grasps sheet bundle Sa accumulated in sheet bundle storing device 40 by pressing it in a thickness direction. At a stage where sheets S of a set quantity are stored in sheet bundle storing device 40, pressing member 45 is operated through an unillustrated driving device so as to grasp and hold sheet bundle Sa by the grasping device configured with supporting member 41 and pressing member 45.

Figure 4:
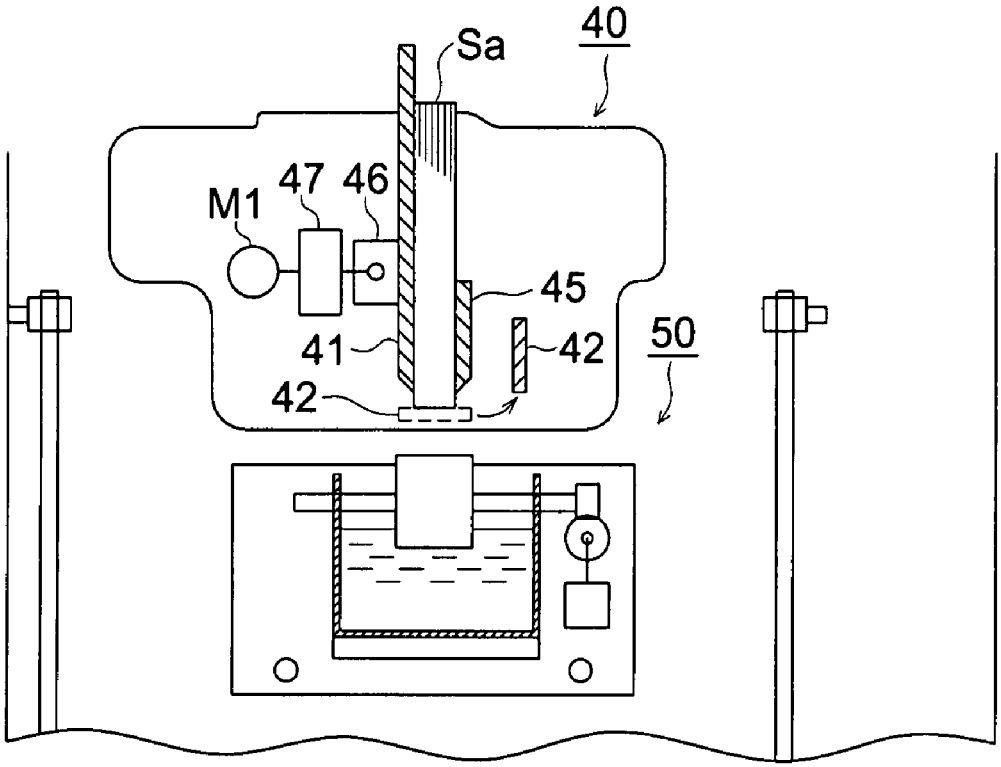
FIG. 4 is a cross-sectional view of a status where the sheet accumulating device of the sheet bundle storing device is vertically disposed.

FIG. 4 is a cross-sectional view showing a status where the sheet accumulating device of sheet bundle storing device 40 is disposed vertically.

Supporting member 41 and pressing member 45 holding sheet bundle Sa are rotated centering on axis 46 of sheet bundle storing device 40 through an unillustrated motor M1 and driving device 47 so that sheet bundle Sa becomes vertical status from oblique status. In this status, adhesive applying device 50 is retracted downward and a bottom surface of sheet bundle Sa is detached from adhesive applying roller 51 of adhesive applying device 50.

Also, in a status where supporting member 41 and pressing member 45 are holding sheet bundle Sa, receiving plate 42 is rotated and retracted from a broken lines position to a solid line position shown by the figure through an unillustrated driving device.

<Adhesive Applying Device 50>

Figure 5:
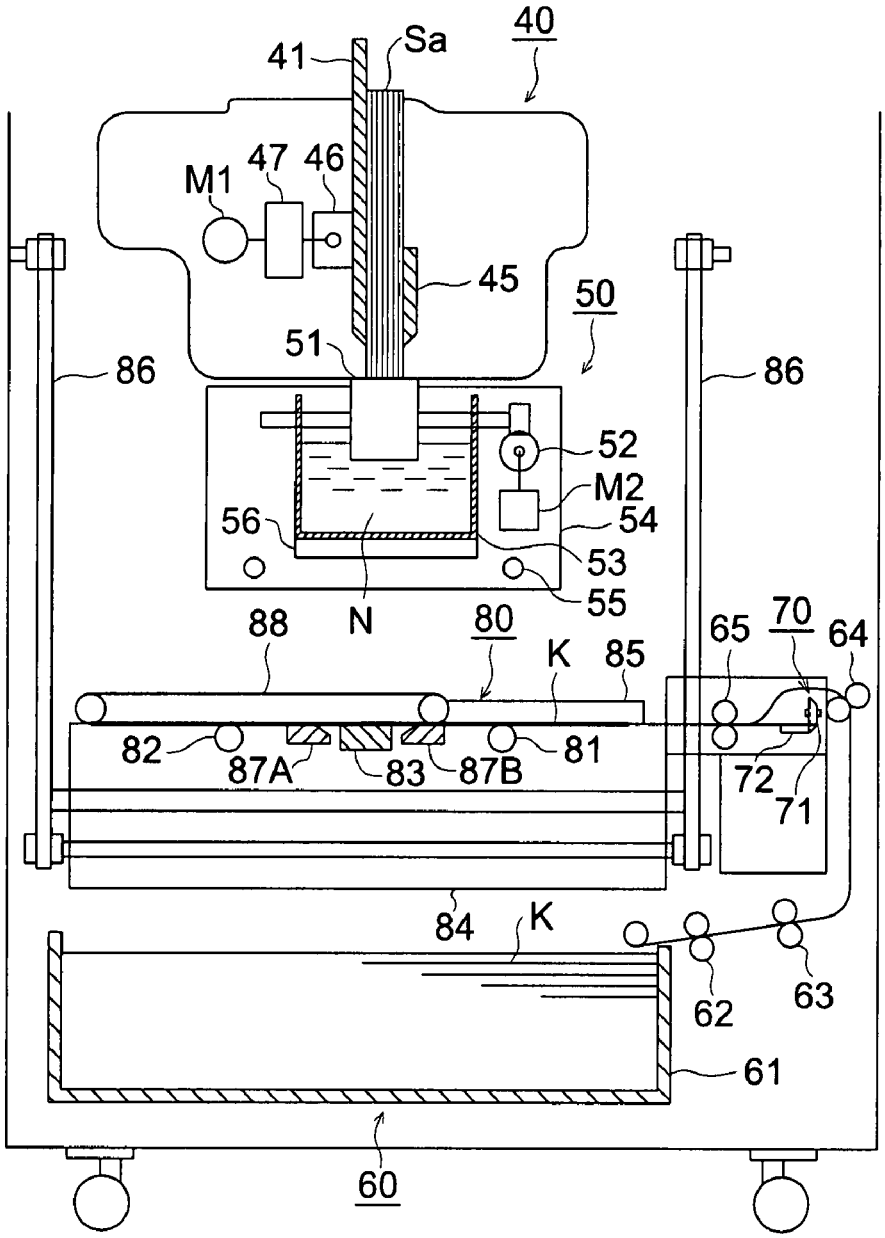
FIG. 5 is a cross-sectional view showing the sheet bundle storing device, an adhesive applying device, a coversheet supplying device, a coversheet cutting device and a square spine forming device.

FIG. 5 is a cross-sectional view showing sheet bundle storing device 40, adhesive applying device 50, coversheet supplying device 60, coversheet cutting device 70 and square spine forming device 80.

Adhesive applying device 50 includes adhesive applying roller 51, driving device 52 to rotate the aforesaid adhesive applying device 50, adhesive container 53 to contain adhesive (glue) N, moving body 54 which supports adhesive container 53 and moves from a initial position at rear surface side R of bookbinding apparatus B to an adhesive applying position at front surface side F, adhesive container moving device 55 to reciprocate moving body 54, and heating device 56 to heat adhesive N contained in adhesive container 53.

<Applying Adhesive to Sheet Bundle>

Moving body 54 of adhesive applying device 50 is moved by an unillustrated driving device in a direction parallel to a longitudinal direction of a bottom surface of sheet bundle Sa which is held vertically by the grasping device configured with supporting member 41 and pressing member 45.

Moving body 54 starts to move from the initial position at rear surface side R of bookbinding apparatus B and moves along adhesive container moving device 55 then stops at a predetermined position at front surface side F of bookbinding apparatus B. After that moving body 54 is driven in reverse way to return to the initial position.

Figure 6:
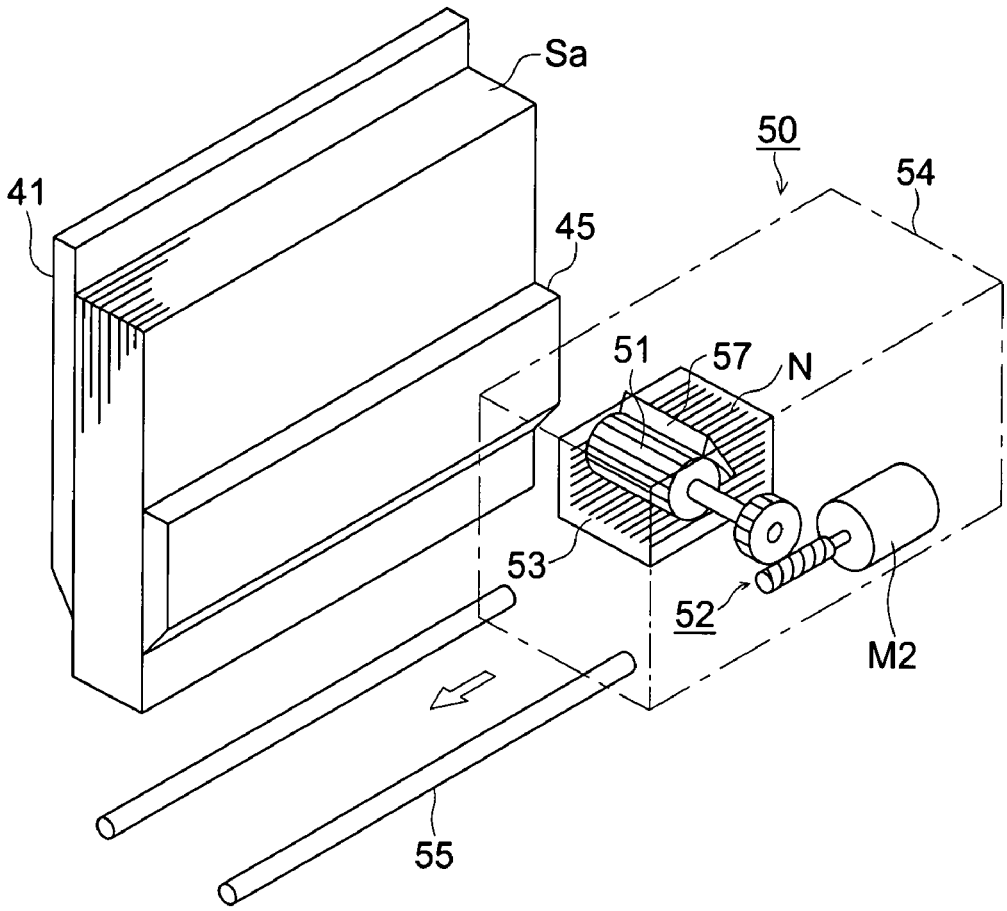
FIG. 6 is a perspective view showing the adhesive applying device and a grasping device.

FIG. 6 is a perspective view showing adhesive applying device 50 and grasping device.

Adhesive applying roller 51 immersed in adhesive container 53 containing adhesive N is rotated by motor M2 and driving device 52. Adhesive applying roller 51 applies adhesive N on the bottom surface of sheet bundle Sa in its longitudinal direction in a stroke or in reciprocations of moving body 54.

Adhesive N applied on an outer circumferential surface of rotating adhesive applying roller 51 is controlled and uniformed in its layer thickness by adhesive layer control member 57.

<Coversheet Supplying Device 60>

As FIG. 5 shows, front coversheet (hereinafter called coversheet) K which is stored in coversheet loading device 61 of coversheet supplying device 60 is separated and fed by sheet supplying device 62, and then grasped by conveyance rollers 63, 64 and 65 to be conveyed to square spine forming device 80.

<Coversheet Cutting Device 70>

Coversheet cutting device 70, integrally constructed on the right of square spine forming device 80 to be described and above coversheet supplying device 60 in the figure, cuts a coversheet in a predetermined length in a conveyance direction of coversheet K by a rotary cutter configured with rotation blade 71 and fixed blade 72.

The predetermined length is a length which is two times of the length of sheet S in sheet conveyance direction and a length of the spine. For example, in case of case binding where coversheet K is bonded onto the spine of sheet bundle Sa which is configured with sheet S having A4 size, provided that a maximum number of sheets in sheet bundle Sa is 300 pieces and a maximum thickness is approximately 30 mm, the predetermined length is set at 450 mm which is two times of length of short side of A4 of 210 mm and the thickness of the sheet bundle of 30 mm, thereby an end section of coversheet K is cut. A wide size exceeding 450 mm is used as a length of coversheet K before cutting.

Also, in case booklet Sb is made through case binding using sheets S having each of A5 size, B5 size and 8.5×11 inch size (1 inch is 25.4 mm), the predetermined size is set based on the length of short side of the sheet and the thickness of the sheet bundle.

When the sheet size, the number of the sheets and the thickness of the sheet are selected or detected through operation device 9 of image forming apparatus main body A or through the external devices, a control device sets a predetermined cutting length of coversheet K. The length of coversheet K before cutting is determined in advance in accordance with an maximum number of sheets and stored in coversheet loading device 61 of coversheet supplying device 60.

<Square Spine Forming Device 80>

Square spine forming device 80 has conveyance rollers 81 and 82 to receive, convey and stop at a predetermined position coversheet K supplied from coversheet supplying device 60, supporting member 83 to press coversheet K onto an adhesive applying surface of sheet bundle Sa, moving housing 84 to support conveyance rollers 81 and 82, and supporting member 83, and elevating device 86 to vertically ascend and descend aligning device 85 and moving housing 84.

Spine forming device 80 and booklet ejection belt 88 are ascended and descended integrally by elevating device 86.

When square spine forming device 80 stops at descending position so as to bring in coversheet K, aligning device 85 moves from the initial position in accordance with the size of coversheet K and presses both side surfaces of coversheet K in the width direction before cutting process so as to align the width. Coversheet K of which skew is corrected through width aligning is switched back in a reverse direction of a direction of bringing in and conveyed to coversheet cutting device 70 to be cut in a predetermined position.

Also, before square spine forming device 80 joints coversheet K after cutting with the spine of sheet bundle Sa in the descending position, aligning device 85 is again moves from the initial position and presses both side surfaces of coversheet K in the width direction to carry out width aligning, then places coversheet K in a predetermined position. After that aligning device 85 returns to the initial position without bothering the jointing of coversheet K and sheet bundle Sa, then subsequently square spine forming device 80 ascends. Coversheet K is supported in a predetermined position while ascending.

Therefore, aligning device 85 disposed on square spine forming device 80, which can ascend and descend, carries out positioning in the width direction of coversheet K before and after cutting by coversheet cutting device 70, thereby improvement of coversheet cutting accuracy and positioning accuracy of sheet bundle Sa against coversheet K, as well as simplification of the structure can be achieved.

Elevating device 86 rotate left and right belts so as to move moving housing 84 upward. At this ascending position, a center section of coversheet K loaded on supporting member 83 is pressed and bonded onto the adhesive applying surface of sheet bundle Sa. Adhesive applying device 50 is retracted backward after adhesive applying process to sheet bundle Sa is completed.

<Coversheet Folding Process>

At upper section of square spine forming device 80, a coversheet folding device is disposed. The coversheet folding device has a pair of symmetrical forming members 87A and 87B. Forming members 87A and 87B can attach and detach to/from sheet bundle Sa in a direction of a thickness of sheet bundle Sa. Forming members 78A and 87B fold coversheet K along a side edge of the adhesive applying surface of sheet bundle Sa and a front coversheet and a rear coversheet lap front and rear surfaces of sheet bundle Sa.

After folding process of coversheet K is completed, square spine forming device 80 descents a predetermined amount by descending drive of elevating device 86 to be retracted and to stop. Thereafter, when grasping by the grasping device is released, booklet Sb falls and a lower surface of the spine comes in contact with upper surface of ejection belt 88 and the booklet Sb is loaded on the surface thereof to be ejected.

Figure 7:
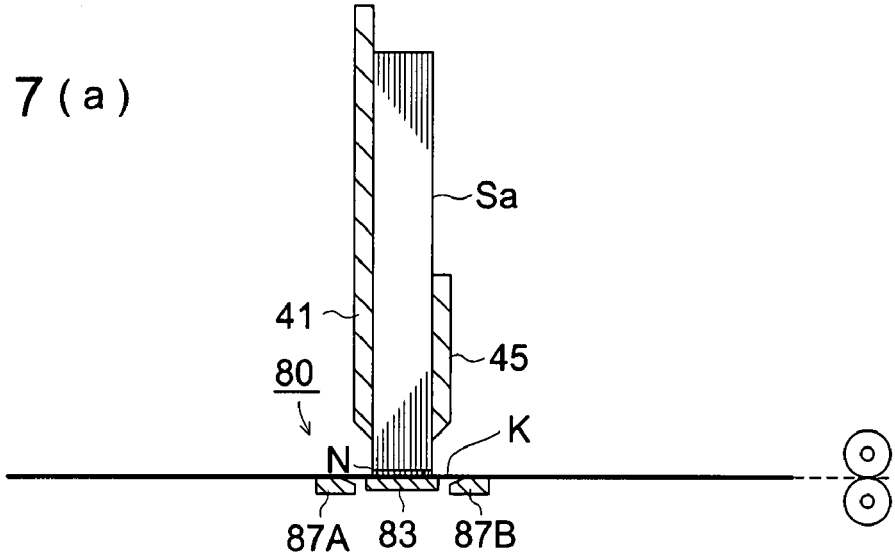
FIG. 7 (*a*)-FIG. 7 (*d*) are cross-sectional views of the square spine forming device and a sheet bundle explaining a process of folding a coversheet.
Figure 7:
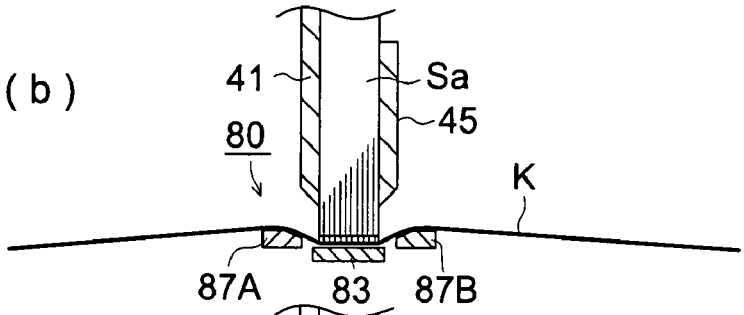
Figure 7:
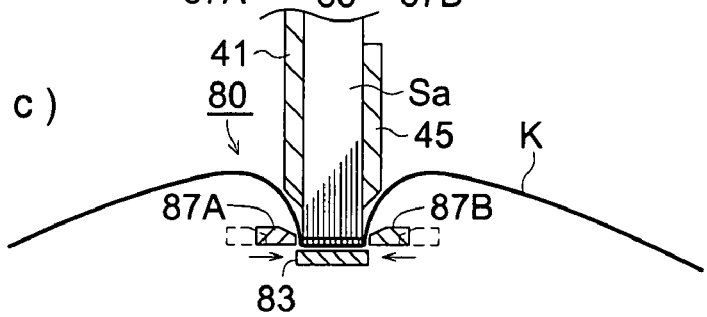
Figure 7:
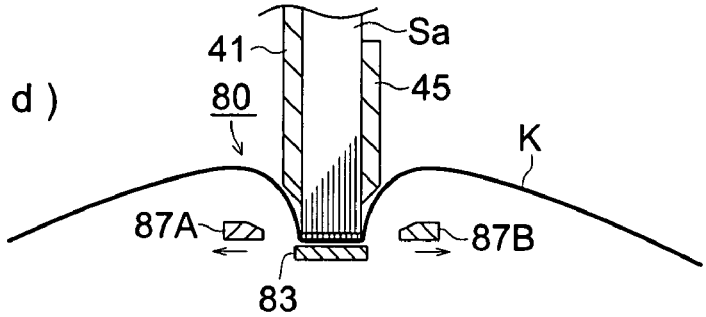

FIG. 7(*a*) to FIG. 7(*d*) are a cross-sectional views of square spine forming device 80 and sheet bundle Sa showing a folding process of coversheet K. FIG. 7(*a*) shows a status where coversheet folding is started, FIG. 7(B) shows a status of a middle of coversheet folding, FIG. 7(*c*) is a status where coversheet folding is completed and FIG. 7(*d*) shows a status where a pressure of coversheet folding is released.

Figure 8:
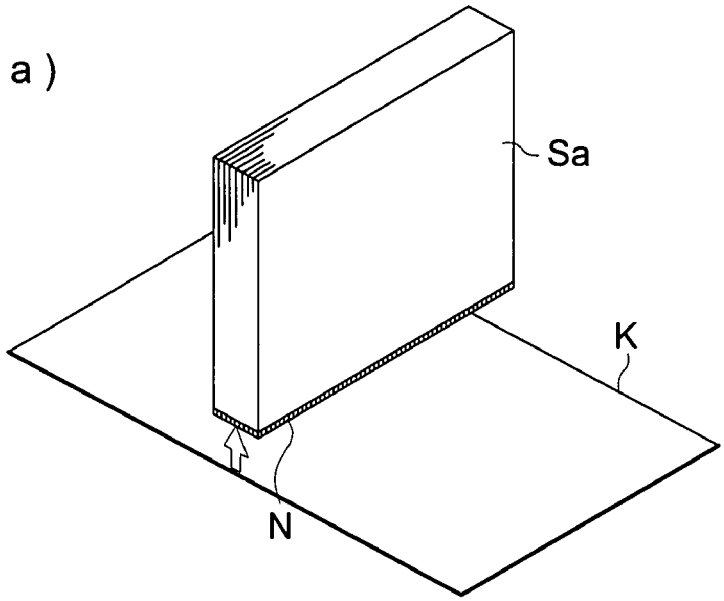
FIG. 8 (*a*)-FIG. 8(*c*) are perspective views indicating a forming process of booklet using the sheet bundle and the coversheet.
Figure 8:
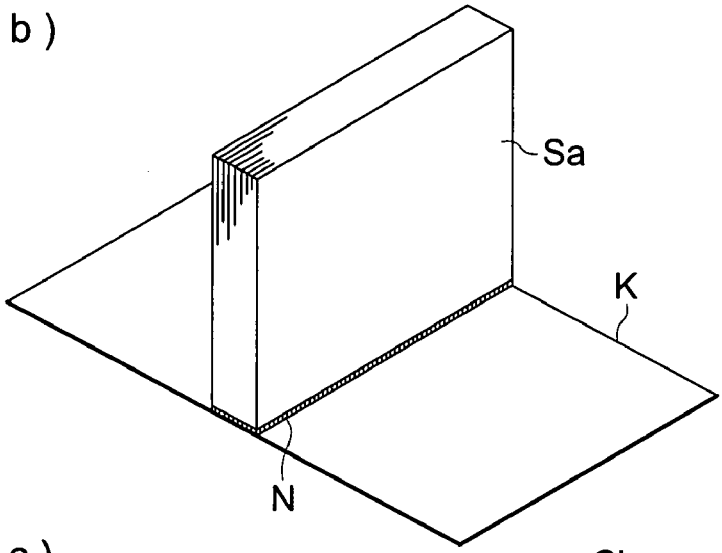
Figure 8:
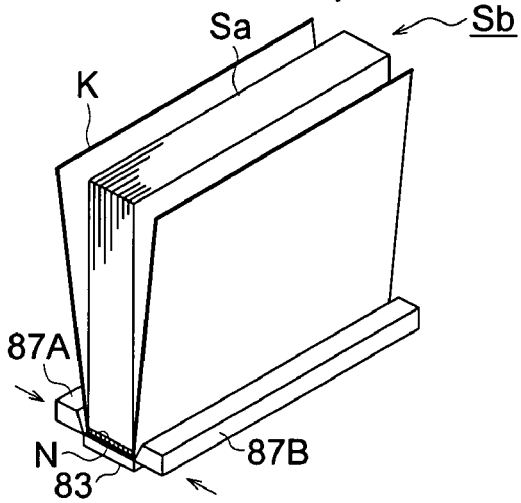

FIG. 8(*a*) to FIG. 8(*b*) are perspective views showing a forming process of booklet Sb using sheet bundle Sa and coversheet K. FIG. 8(*a*) is a perspective view showing coversheet K and sheet bundle Sa in a status before bonding process, FIG. 8(*b*) a perspective view of sheet bundle Sa where coversheet K is bonded, and FIG. 8(*c*) is a perspective view of booklet Sb to be formed where coversheet K is case bound on sheet bundle Sa.

After coversheet K and sheet bundle Sa on which adhesive N is applied are bonded, forming members 87A and 87B are driven by an unillustrated driving device in an ascent status of square spine forming device 80 shown in FIG. 8. Coversheet K is grasped by forming members 87A and 87B and deformed from the side edge section of adhesive applying surface (Refer to FIG. 7(*b*)).

Thereafter, forming members 87A and 87B move horizontally towards the adhesive applying surface side of sheet bundle Sa so as to press both side surfaces of sheet bundle Sa for shaping, thereby booklet Sb is formed.

As FIG. 1 shows, pressing member 45 opens to release grasping, then booklet Sb falls and is loaded on the upper surface of ejection belt 88 to be conveyed in a direction of booklet ejecting outlet 89 and ejected to booklet storing device C outside the apparatus.

Ejected booklet sb is loaded on conveyance belt 91, which can ascend and descend, of booklet storing device C and is ejected successively by rotation of conveyance belt 91, thereby loaded and stored on ejected sheet table 92.

<Installation of Sheet Bundle into Sheet Bundle Storing Device>

Figure 9:
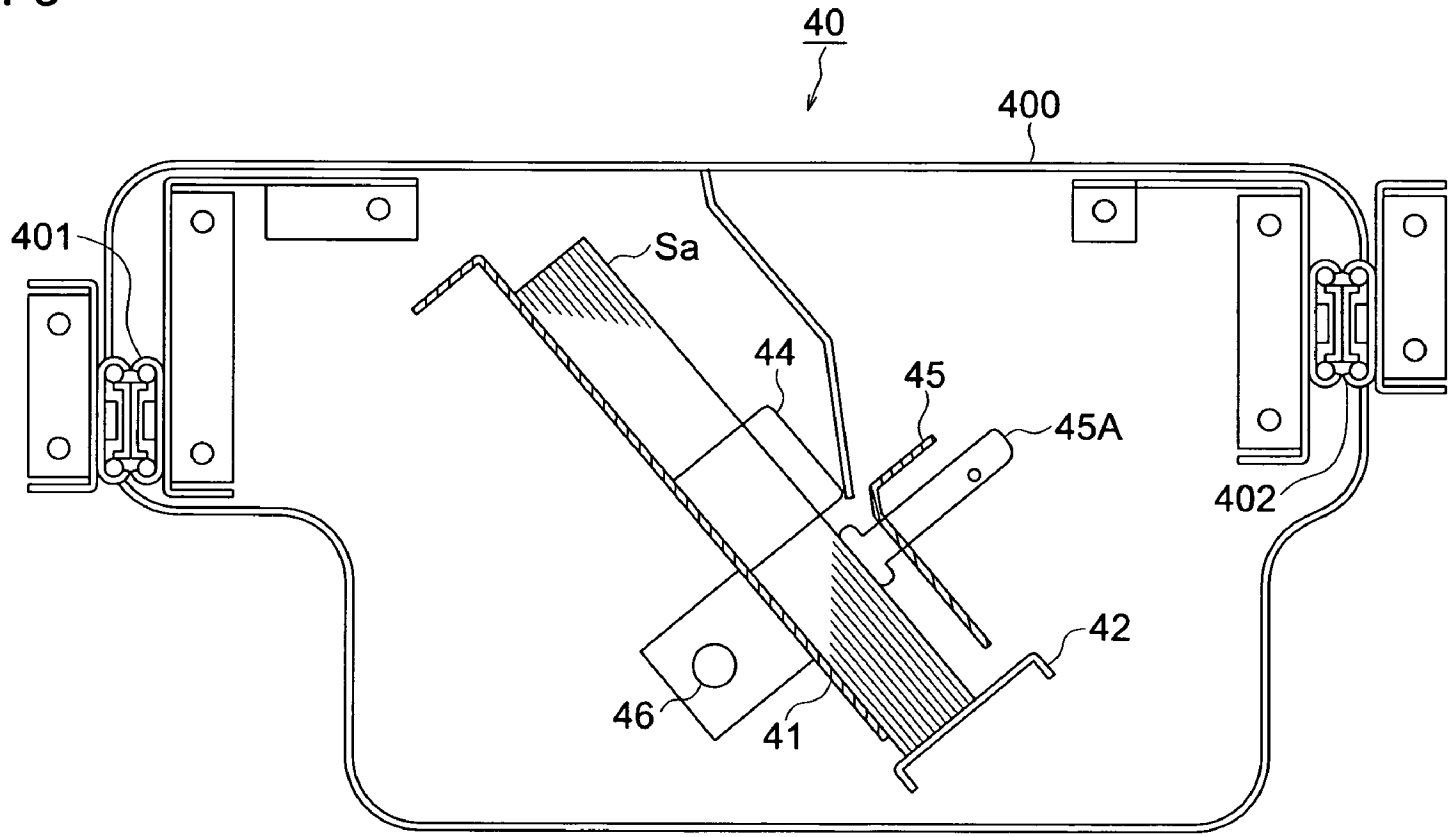
FIG. 9 is a cross-sectional view of the sheet bundle storing device.

FIG. 9 is a cross-sectional view of sheet bundle storing device 40.

Housing 400 of sheet bundle storing device 40 is supported by slide bearings 401 and 402 representing the moving device to be able to withdraw from the bookbinding apparatus main body.

When sheet S ejected form sheet reversal device 30 is stored in sheet bundle storing device 40 or when sheet bundle storing device 40 is in an initial status, as FIG. 3 and FIG. 9 show, the sheet bundle supporting device configured with supporting member 41, receiving plate 42, lateral aligning member 44 and pressing member 45 and 45A is obliquely supported.

In present the embodiment, since sheet bundle Sa set in sheet bundle storing device 40 is loaded on a surface of supporting member 41 and grasped by pressing device 45 and 45A at the same position, unlike the Patent document 1, sheet bundle Sa does not have to be conveyed from sheet bundle storing device 40 to a position of grasping. Therefore shortening of a process time of bookbinding where bookbinding apparatus B is operated by its own becomes possible.

Figure 10:
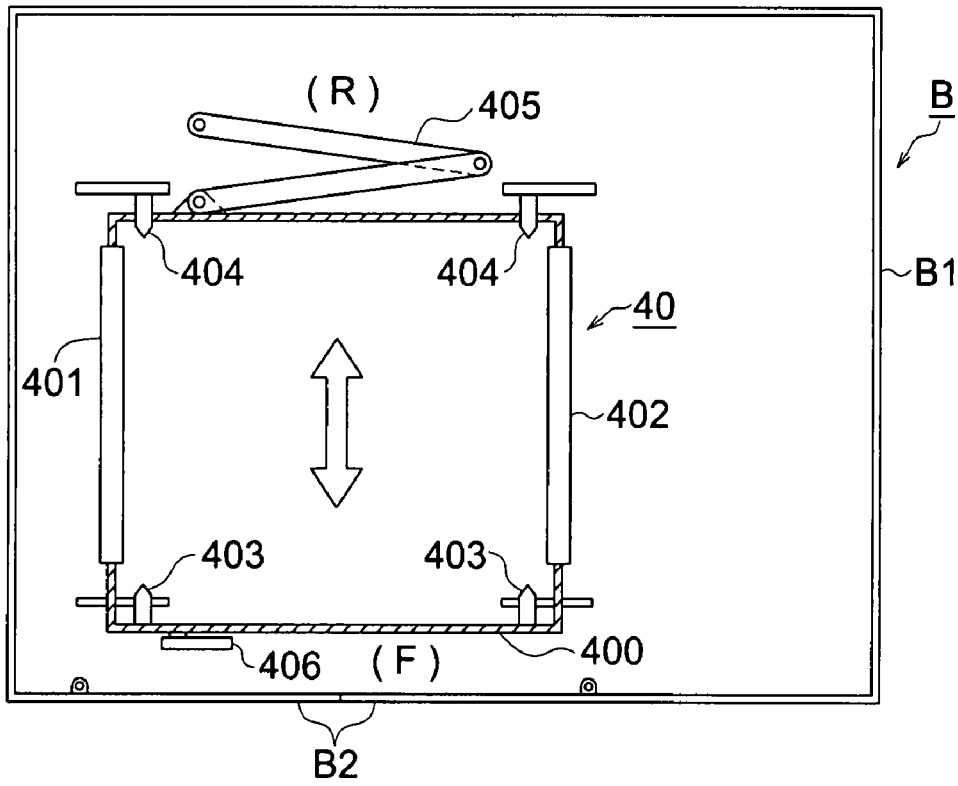
FIG. 10 is a plane view of a bookbinding apparatus main body and the sheet bundle storing device.

FIG. 10 is a plane view showing bookbinding apparatus main body B1 and sheet bundle storing device 40.

Housing 400 of sheet bundle storing device 40 is slidably supported in an outlined arrow direction shown in the figure by bookbinding apparatus main body B1 through slide bearings 401 and 402.

Two projecting members 403 implanted on front surface side F of housing 400 engage with holes made in predetermined positions on bookbinding apparatus main body B1 so as to position front surface side F of hosing 400. Also two projecting members 404 implanted in predetermined positions on bookbinding apparatus main body B1 engage with holes made on rear surface side R of hosing 400 so as to position rear surface side R of housing 400.

On rear surface side R of housing 400, folding device 405 where two arms are linked in V-shape is disposed. An end section of one arm is supported by bookbinding apparatus main body B1 and an end section of the other arm is supported by rear surface side R of housing 400.

Grip 406 disposed on front surface side F of housing 400 is used when housing 400 is moved manually. Also, it operates a locking mechanism to lock housing 400 while being retracted as well as to unlock housing 400 when stating moving.

Figure 11:
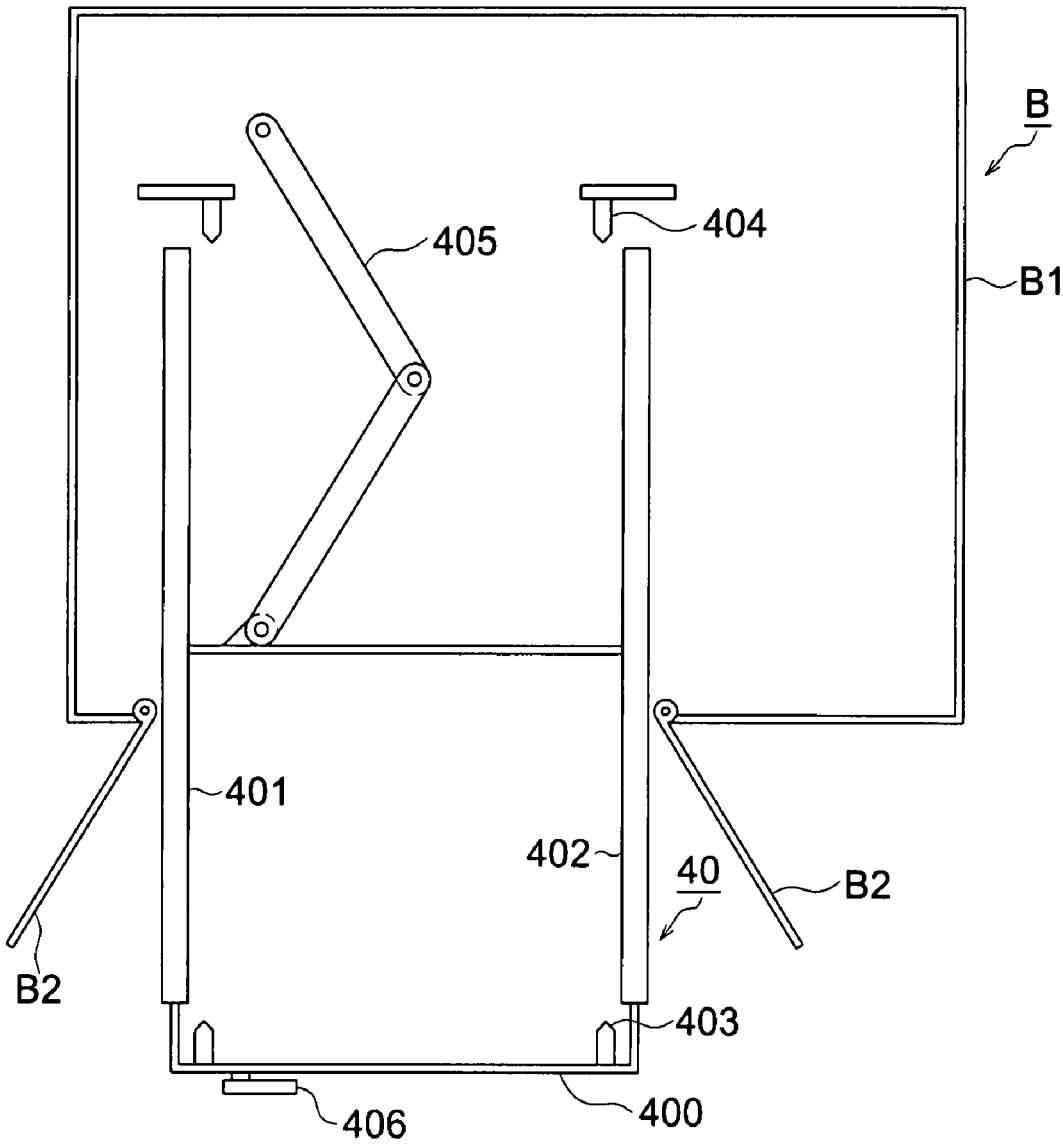
FIG. 11 is a plane view of a status where the sheet bundle storing device is withdrawn from the bookbinding apparatus main body.

FIG. 11 is a plane view showing a status where sheet bundle storing device 40 is being withdrawn from bookbinding apparatus main body B1.

When sheet bundle Sa of printed matters, which are printed outside, is stored in sheet bundle storing device 40, offline systems, on which only bookbinding apparatus B is operated alone, is selected and front door B2 of bookbinding apparatus main body B1 is opened so as to release the lock by operating grip 406 of sheet bundle storing device 40, thereafter sheet bundle storing device 40 is withdrawn forward by holding grip 406.

The upper part of withdrawn sheet bundle storing device 40 is opened and the sheet bundle supporting device configured with supporting member 41, receiving plate 42, lateral alignment member 44, and pressing member 45 and 45A is exposed.

An operator grasps sheet bundle Sa and places it on the surface of supporting member 41 in an oblique condition shown in FIG. 9 then contacts the front end section of sheet bundle Sa to receiving plate 42 so as to align the front end section. Meanwhile, at this stage, pressing members 45 and 45*a* are retracted backward by a distance more than a maximum thickness of the sheet bundle.

Next, lateral aligning of sheet bundle Sa is conducted by operating lateral aligning member 44 manually. Sheet bundle storing device 40 storing sheet bundle Sa which is positioned through front end section aligning and lateral aligning is pushed back into bookbinding apparatus main body by operating grip 406 manually. Then housing 400 is aligned by projecting members 403 and 404.

Thereafter, when bookbinding start button 9A disposed on an upper section of bookbinding apparatus B is pressed (refer to FIG. 1), sheet bundle supporting device configured with supporting member 41, receiving plate 42, lateral aligning member 44, and pressing members 45 and 45A stands vertically, then the aforesaid processes such as applying adhesive, coversheet bonding, forming spine and ejecting booklet are carried out. In present embodiment, the grasping device grasps sheet bundle Sa in the same position where sheet bundle is set in sheet bundle storing device 40. Thereby, unlike the Patent document 1, sheet bundle Sa does not have to be moved from sheet bundle storing device 40 to a grasping position by the grasping device. Thus, in case bookbinding is carried out by operating bookbinding apparatus B by itself, a time period of bookbinding processing can be shortened.

According aforesaid the embodiment the following can be realized:

1. In the post-processing apparatus related to the present embodiment the moving device is provided, which enables the sheet bundle storing device to load the sheets and store them as a sheet bundle withdrawn outside the apparatus main body. Thereby the sheet bundle can be stored in the sheet bundle storing device at once with a simple operation, as the result, post-processing such as binding process and adhesive applying process can be carried out rapidly.

2. In the bookbinding apparatus related to the present embodiment, in case the bookbinding apparatus is manually used, the sheet bundle storing device is withdrawn outside the apparatus main body, thus the sheet bundle can be set from outside in the sheet bundle storing device, thereby adhesive applying bookbinding process can be completed in a short time.

3. In the image forming system related to the present embodiment, by the image forming apparatus connected with the bookbinding apparatus, online system where a job from image forming to bookbinding or post-processing is carried out automatically and offline system where bookbinding is conducted by itself can be switched over appropriately to carry image forming process and bookbinding process, thereby efficiency of bookbinding or post-processing is improved.

What is claimed is:

1. A post-processing apparatus configured to change between an online system to conduct post-processing wherein a plurality of sheets from an image forming apparatus are received and an offline system wherein the post-processing is conducted alone, comprising:

a sheet conveyance device to convey the sheets;

a post-processing device to conduct the post-processing, wherein the post-processing includes book binding; and a sheet bundle storing device, having a supporting member to accumulate the sheets thereon, wherein the sheets are subject to the book binding while the sheets are disposed on the supporting member, a receiving plate disposed at a position of a front edge of a sheet bundle on the supporting member in a forwarding direction, a lateral aligning member to conduct lateral aligning of the sheet bundle accumulated on the supporting member in a width direction, the lateral aligning member configured to switch between an automatic operation in the online system and a manual operation in the offline system, a pressure member to press the sheet bundle onto the supporting member, a grasping device to grasp the sheet bundle by pressing the sheet bundle between the supporting member and pressure member, and position the sheet bundle at a post-processing position in a state of grasping by pressure, and a moving device to move the sheet bundle storing device to outside the post-processing apparatus;

wherein when the online system is selected, the sheets sent from the image forming apparatus are consecutively accumulated on the supporting member by the sheet conveyance device, lateral aligning is conducted by operating the lateral aligning member, the supporting member and the pressure member in the state where the sheet bundle is grasped by pressure by operating the grasping device are positioned at the post-processing position after completion of accumulation and aligning, and the post-processing is conducted by the post-processing device, and when the offline system is selected, the sheet bundle is placed on the supporting member of the sheet bundle storing device having been moved outside the post-processing apparatus through the moving device, lateral aligning is conducted manually through the lateral aligning member having been released from driving, and after the sheet bundle storing device is returned to an initial position, the post-processing is conducted by operating the grasping device and the post-processing device.

2. The post-processing apparatus of claim 1, wherein the receiving plate is held in a swing manner so that the receiving plate is retracted when the grasping device is operated.

3. The post-processing apparatus of claim 1, wherein the grasping device changes position of the supporting member between an oblique state to receive the sheets from the sheet conveyance device and a vertical state where an edge surface of the sheet bundle stacked is subject to the post-processing.

4. A book binding apparatus configured to change between an online system to conduct book binding processing wherein a plurality of sheets from an image forming apparatus are received and an offline system wherein the book binding is conducted alone, comprising:

a sheet conveyance device to convey the sheets;

a book binding device to conduct book binding; and a sheet bundle storing device, having a supporting member to accumulate the sheets thereon, wherein the sheets are subject to the book binding while the sheets are disposed on the supporting member, a receiving plate disposed at a front edge of a sheet bundle on the supporting member in a forwarding direction, a lateral aligning member to conduct lateral aligning of the sheet bundle accumulated on the supporting member in a width direction, the lateral aligning member configured to switch between an automatic operation in the online system and a manual operation in the offline system, a pressure member to press the sheet bundle on the supporting member, a grasping device to grasp the sheet bundle by pressing the sheet bundle between the supporting member and pressure member, and position the sheet bundle at a book-binding position in a state of grasping by pressure, and a moving device to move the sheet bundle storing device to outside the book binding apparatus;

an adhesive applying device to apply an adhesive on the edge surface of the sheet bundle positioned at the book binding position;

a cover sheet supplying device to supply a coversheet to the edge surface of the sheet bundle to which the adhesive has been applied; and a square spine forming device to form a square spine by contacting the coversheet supplied to the edge surface of the sheet bundle with pressure and folding the coversheet, wherein when the online system is selected, the sheets sent from the image forming apparatus are consecutively accumulated on the supporting member by the sheet conveyance device, lateral aligning is conducted by operating the lateral aligning member, the supporting member and the pressure member in the state where the sheet bundle is grasped by pressure by operating the grasping device are positioned at the book-binding position after completion of accumulation and aligning, and the book binding is conducted by the book binding device, and when the offline system is selected, the sheet bundle is placed on the supporting member of the sheet bundle storing device having been moved outside the book binding apparatus through the moving device, lateral aligning is conducted manually through the lateral aligning member having been released from driving, and after the sheet bundle storing device is returned to an initial position, the book binding is conducted by operating the grasping device and the book binding device.

5. The book binding apparatus of claim 4, wherein the receiving plate is held in a swing manner so that the receiving plate is retracted when the grasping device is operated.

6. The book binding apparatus of claim 4, wherein the grasping device changes position of the supporting member between an oblique state to receive the sheets from the sheet conveyance device and a vertical state where an edge surface of the sheet bundle stacked is subject to book binding.

7. The book binding apparatus of claim 4, wherein the adhesive applying device, configured to be movable in a horizontal direction, moves horizontally to the edge surface of the sheet bundle held in a vertical state by the grasping device so as to apply the adhesive and moves to a retraction position after application, and after the coversheet supplied from the coversheet supplying device is placed on the square spine forming device, the square spine forming device ascends to make the coversheet contact with the edge surface of the sheet bundle with pressure to form a square spine, wherein the coversheet supplying device and the square spine forming device are disposed at a lower portion of the book binding apparatus.

8. An image forming system, comprising:

an image forming apparatus main body to form an image on a recording sheet based on document data; and a post-processing apparatus according to claim 1.

9. An image forming system, comprising:

an image forming apparatus main body to form an image on a recording sheet based on document data; and a book binding apparatus according to claim 4.

* * * * *